United States Patent [19]

Wensing

[11] Patent Number: 5,040,735

[45] Date of Patent: Aug. 20, 1991

[54] MEAT GRINDER WITH MEAT TEARING ATTACHMENT

[75] Inventor: Günther Wensing, Stadtlohn, Fed. Rep. of Germany

[73] Assignee: Karl-Heinz Otten, Ottersberg, Fed. Rep. of Germany; a part interest

[21] Appl. No.: 486,539

[22] Filed: Feb. 28, 1990

[30] Foreign Application Priority Data

Mar. 10, 1989 [DE] Fed. Rep. of Germany ..... 3907752

[51] Int. Cl.[5] ..... B02C 18/36

[52] U.S. Cl. ..... 241/82.1; 241/276

[58] Field of Search ..... 241/82.1-82.7, 241/277, 282.1, 282.2, 296, 101.1, 276, 274

[56] References Cited

U.S. PATENT DOCUMENTS 2,505,797 5/1950 Sivertsen ..... 241/82.4

4,928,892 5/1990 Huebner et al. ..... 241/296 X

FOREIGN PATENT DOCUMENTS 3744433 2/1989 Fed. Rep. of Germany ..... 241/82.5

*Primary Examiner*—Mark Rosenbaum

*Attorney, Agent, or Firm*—Peter K. Kontler

[57] ABSTRACT

A meat grinder wherein the meat discharging end of the barrel for the rotary feed screw is separably connected with a tubular member having an extension which is remote from the barrel and is provided with a lateral meat evacuating opening. A star-shaped meat tearing or ripping member is installed in the tubular member upstream of the evacuating opening and has a bearing for the rear end portion of a shaft the front end portion of which is connected to a transverse front end wall of the extension. The latter is surrounded by a tubular element which has a lateraly opening and is rotatable relative to the extension to move its opening to a position of greater lesser register or overlap with the opening of the extension and to thus vary the rate of discharge of meat from the tubular member. A disc-shaped baffle is mounted on the shaft adjacent the opening of the extension and is movable to any one of several different positions axially of the shaft. The rear end portion of the shaft is surrounded by a plastic sleeve which is installed upstream of the tearing member and further receives the front end of the shank of the feed screw in the barrel.

16 Claims, 3 Drawing Sheets

MEAT GRINDER WITH MEAT TEARING ATTACHMENT

BACKGROUND OF THE INVENTION

The invention relates to meat grinding machines in general, and more particularly to improvements in meat grinders of the type disclosed in commonly owned German Pat. No. 37 44 433.

The meat grinder which is disclosed in the German patent has a barrel for a feed screw which advances meat beyond the discharging end of the barrel and into a tubular member which is separably affixed to the discharging end of the barrel by a nut. The tubular member has an extension with a lateral meat evacuating opening flanked by serrated or otherwise roughened edge faces to rip or tear the pieces of meat on their way from the extension. The extension has an end wall which is remote from the barrel and serves to rotatably support one end of an elongated shaft the other end of which receives the front end of the rotary shank of the feed screw. The tubular member has internal protuberances serving to prevent rotation of pieces of meat which are forced to advance from the barrel toward and into the lateral evacuating opening of the extension. The feed screw can be rotated by hand or by a suitable motor.

An advantage of the patented meat grinder is that is does not sever the pieces of meat but merely tears the pieces on their way toward the evacuating opening. This preserves the fibers and enhances the consistency and appearance of the product which is discharged from the extension. Such meat grinders have been found to constitute substantial improvements over conventional meat grinders which are devoid of any means for tearing or ripping the pieces of meat on their way from the barrel toward and through the evacuating opening. Moreover, the patented meat grinder can be readily taken apart to afford access to all parts which require cleaning prior to storage as well as prior to actual use.

OBJECTS OF THE INVENTION

An object of the invention is to provide a meat grinder which is at least as simple as but much more versatile than the patented meat grinder.

Another object of the invention is to provide the meat grinder with novel and improved means for ripping or tearing the pieces of meat on their way from the barrel for the feed screw toward the meat evacuating opening.

A further object of the invention is to provide a meat grinder wherein the meat ripping or tearing action is more pronounced than in heretofore known meat grinders.

An additional object of the invention is to provide the meat grinder with novel and improved means for regulating the rate of evacuation of meat from the tearing or ripping station.

Still another object of the invention is to provide a novel and improved method of processing meat in a meat grinder.

A further object of the invention is to provide novel and improved means for opposing the propogation of meat from the barrel for the feed screw toward the meat discharging opening of the above outlined meat grinder.

Another object of the invention is to provide a novel and improved assembly of parts which can be affixed to the barrel of an available meat grinder with minimal modifications of the machine.

SUMMARY OF THE INVENTION

One feature of the present invention resides in the provision of a meat grinder which comprises an elongated hollow barrel having a meat admitting end and a meat discharging end, means for conveying meat in the barrel toward the discharging end, a tubular member which is preferably separably coupled to the barrel by a nut or the like and has a receiving end at the discharging end of the barrel and an extension or outlet element having a lateral meat evacuating opening and being remote from the discharging end of the barrel, a shaft which is disposed within and is spacedly surrounded by the tubular member, and a meat tearing or ripping member which is provided on the shaft between the receiving end of the tubular member and the meat evacuating opening of the extension. The tearing or ripping member is preferably star shaped and is preferably non-rotatably mounted on the shaft so that its prongs define with the tubular member a plurality of passages or paths for forcible advancement of meat from the barrel toward the opening under the action of the conveying means. A bearing of the tearing member serves to center the shaft in the tubular member.

The meat grinder preferably further comprises a baffle which is provided on the shaft in the extension adjacent the meat evacuating opening. Means is provided for releasably coupling the baffle to the shaft; such coupling means can comprise means for releasably holding the baffle on the shaft in a selected position axially of the shaft. The holding means can comprise a plurality of sockets which are provided in and are spaced apart from each other axially of the shaft.

The extension of the tubular member has an end wall which flanks the meat evacuating opening and is remote from the receiving end of the tubular member. A screw, a bolt or other suitable means can be provided for fastening the shaft to the end wall of the extension. The tubular member preferably comprises a tubular section which is provided with the aforementioned receiving end and surrounds the tearing or ripping member.

The shaft has an end portion at the barrel, and the conveying means preferably comprises a feed screw having a rotary shank which is substantially coaxial with the shaft. The meat grinder preferably further comprises a sleeve which is made of or contains a plastic material and surrounds the end portion of the shaft as well as the adjacent portion of the shank.

The meat grinder preferably also comprises means for releasably coupling the tearing and ripping member and the sleeve to the shaft. Still further, the meat grinder can comprise means for varying the effective cross-sectional area of the meat evacuating opening.

Another feature of the invention resides in the provision of a meat grinder which comprises a hollow barrel having a meat admitting end and a meat discharging end, means for conveying meat in the barrel toward the discharging end, a tubular member which is connected with the barrel and has a receiving end adjacent the discharging end and an outlet element (such as the aforediscussed extension) having a lateral meat evacuating opening which is spaced apart from the receiving end of the tubular member, and means for varying the effective area of the evacuating opening. In accordance with a presently preferred embodiment, the means for varying the effective area of the evacuating opening comprises a tubular element having a lateral opening. One of the two elements is telescoped into the other element, and at least one of the two elements is rotatable relative to the other element so as to move the opening of the rotatable element to a position of greater (e.g., full) or lesser (e.g., zero) register with the other opening. It is presently preferred to telescope the outlet element into the tubular element and to rotate the tubular element relative to the outlet element.

The just described meat grinder preferably also comprises a shaft which is disposed within and is spacedly surrounded by the tubular member, and a preferably disc-shaped baffle which is provided on the shaft in the outlet element adjacent the opening of the outlet element. The aforementioned screw or bolt or other fastening means can be used to separably secure or fasten the two elements to the shaft. Still further, the just described meat grinder can comprise the aforediscussed (preferably star-shaped) meat tearing or ripping member which is preferably non-rotatably mounted on the shaft ahead of the lateral opening of the outlet element, as considered in the direction of propagation of meat from the barrel toward and into the lateral opening of the outlet element.

The novel features which are considered as characteristic of the invention are set forth in particular in the appended claims. The improved meat grinder itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
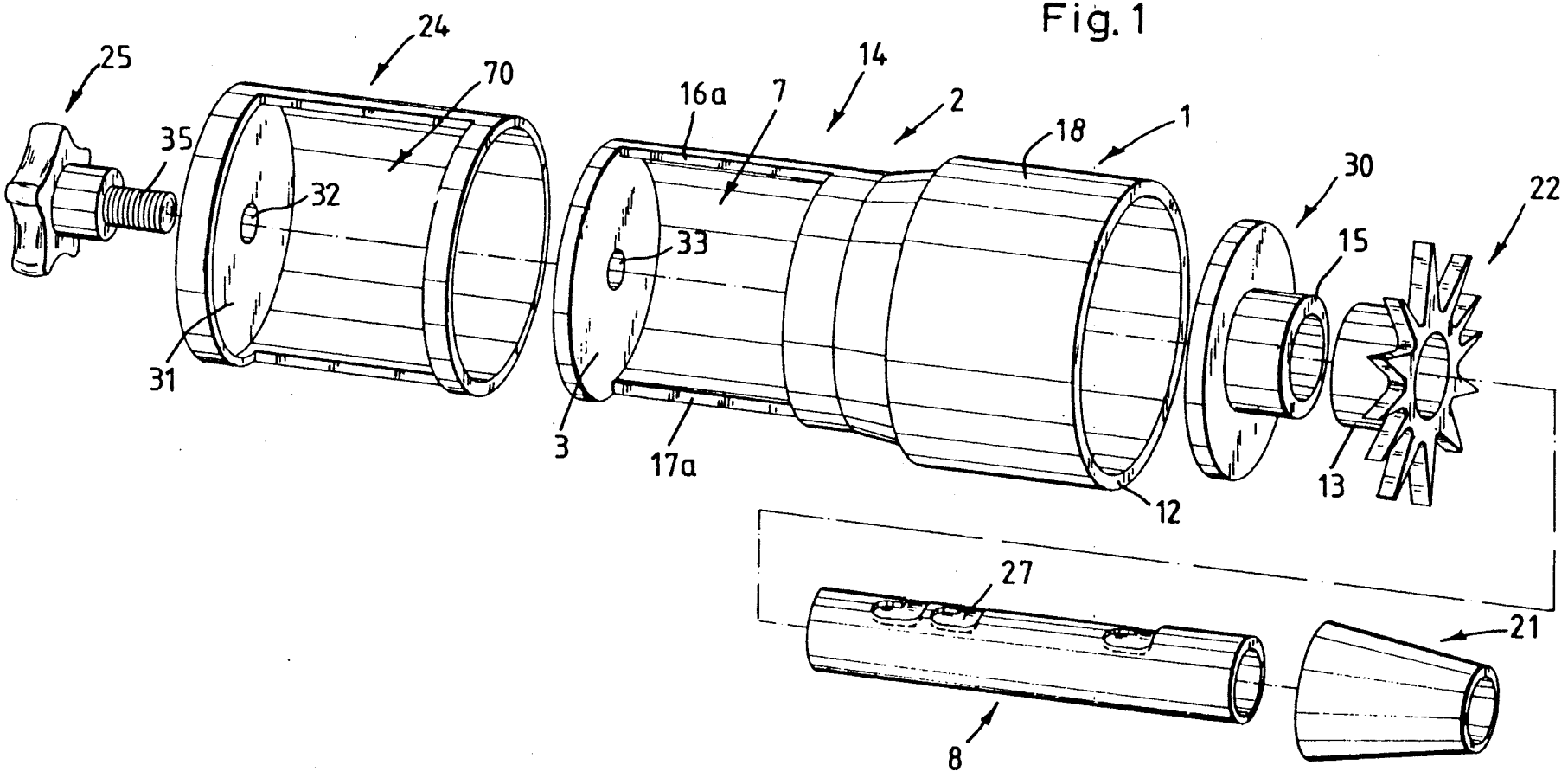
FIG. 1 is an exploded perspective view of a meat grinder which embodies one form of the invention, with the barrel and the meat conveying means omitted.
Figure 2:
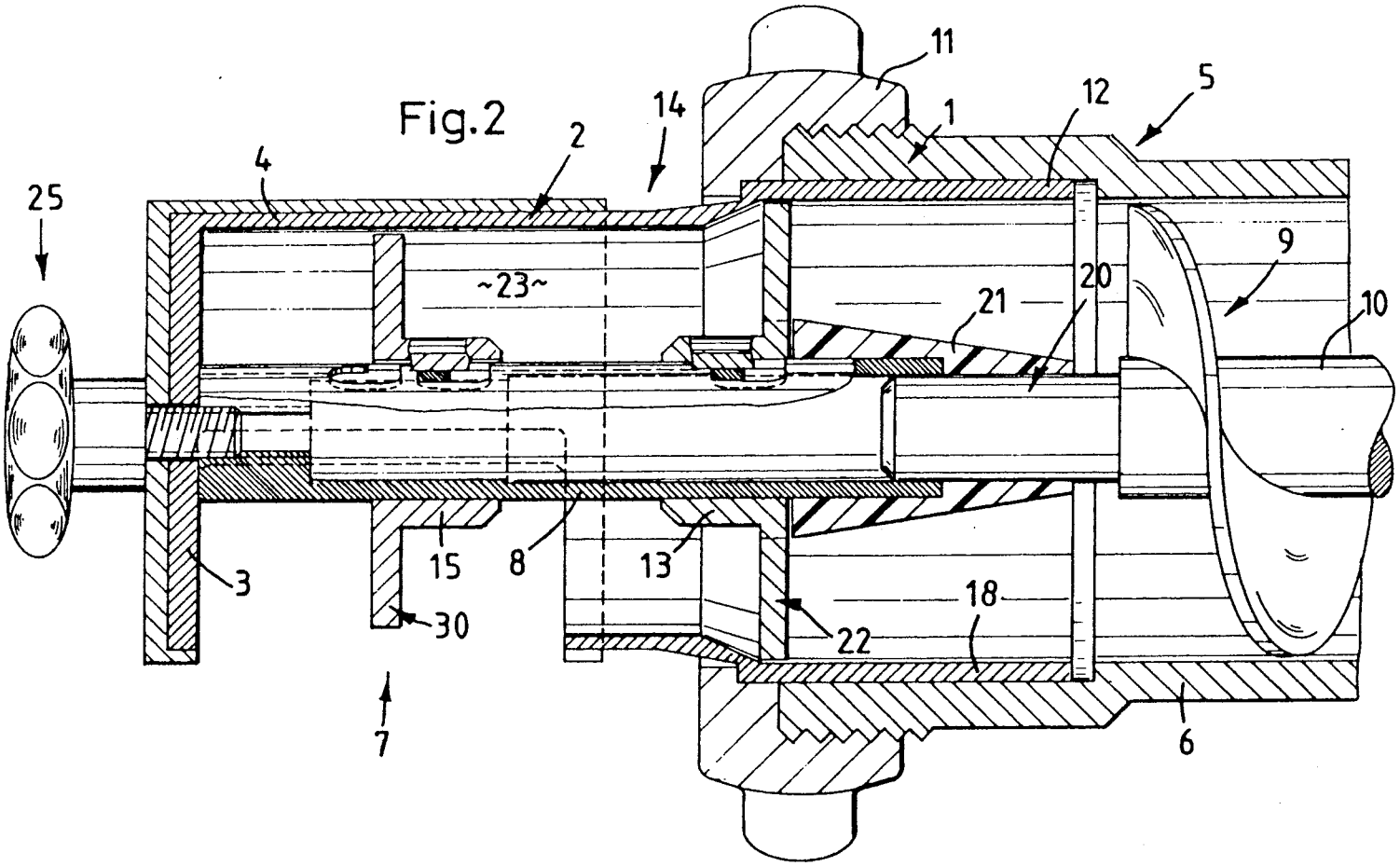
FIG. 2 is an enlarged fragmentary axial sectional view of the assembled meat grinder-and FIG. 3 is an enlarged perspective view of the connection between the shaft and the meat tearing member.

FIG. 1 shows the improved attachment 14 of the meat grinder in an exploded perspective view, and FIG. 2 shows the component parts of the attachment in assembled condition and the tubular member 1 of the attachment separably coupled to the free end of an elongated tubular barrel 5 of the meat grinder by a nut 11. The barrel 5 has a meat admitting end (not shown in FIG. 2) and a meat discharging end 6. The means for conveying pieces of meat from the admitting end toward the discharging end 6 comprises a rotary feed screw 9 having a shank 10 which is coaxial with the barrel 5 and carries a helical thread serving to push pieces of meat toward, through and beyond the discharging end 6.

The nut 11 has an internal shoulder which overlies an external shoulder of the tubular member 1, and the latter comprises a tubular section 18 which extends well into the adjacent portion of the barrel 5 and is integral with a coaxial extension or output element 2 having a lateral meat evacuating opening 7 behind an end wall 3 which is remote from the meat receiving end 12 of the tubular section 18. The extension 2 consists of the end wall 3 and of a substantially semicylidrical shell 4 having two axially parallel edge faces 16*a*, 17*a* which flank the opening 7 (as seen in the circumferential direction of the tubular member 1) and are preferably provided with sharp edges to rip or tear adjacent pieces of meat which issue from the extension 2 by way of the opening 7. The internal space 23 of the extension 2 can be subdivided into two coaxial compartments by a disc-shaped meat deflecting baffle 30 which is adjustably mounted on an elongated at least partially hollow shaft 8. The rear end portion of the shaft 8 receives the front end portion 20 of the shank 10, and the front end portion of this shaft has a tapped bore for the externally threaded stem 35 of a screw, bolt or analogous fastener 25 serving as a means for separably securing the shaft to the end wall 3 of the extension 2 and to the end wall 31 of a tubular element 24 which surrounds and is rotatable relative to the extension.

The tubular element 24 constitutes a means for varying the effective area of the lateral meat evacuating opening 7 and, to this end, has a similar lateral opening 70 which can be moved to a position of full, partial or no overlap with the opening 7 in response to turning of the element 24 relative to the extension (outlet element) 2 and/or vice versa. The screw 25 is preferably used as a means for locking the tubular element 24 in a selected angular position. The stem 35 of this screw extends through bores or holes 32 and 33 which are respectively provided in the end wall 31 of the element 24 and in the end wall 3 of the extension or outlet element 2.

The shaft 8 is preferably coaxial with and is spacedly surrounded by the tubular section 18 of the member 1. This shaft is centered by the stem 35 of the screw 25 and by a cylindrical bearing 13 constituting the hub of a substantially star-shaped meat tearing or ripping member 22 which is installed in the tubular section 18, i.e., upstream of the meat evacuating opening 7 of the extension 2.

Figure 3:
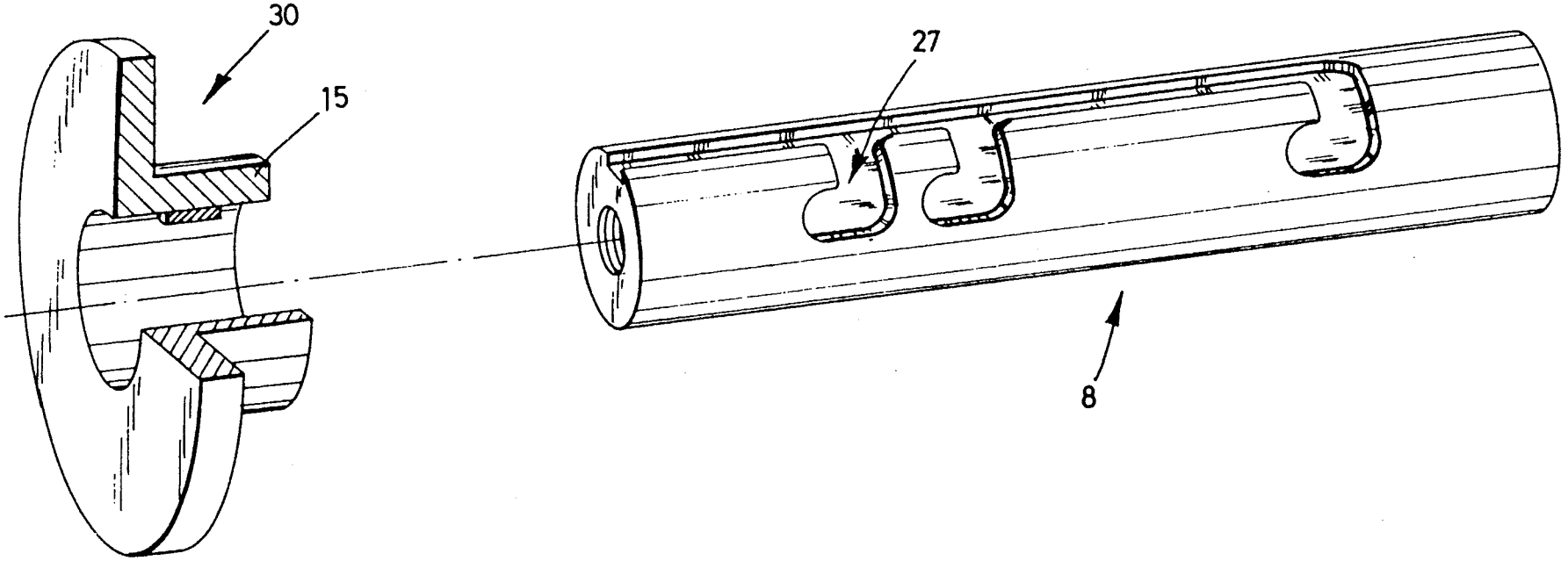

The peripheral surface of the shaft 8 is formed with a row of axially spaced apart sockets 27 forming part of means (See FIG. 3) for releasably coupling the shaft with the meat tearing member 30, with the baffle 30 and with a plastic sleeve 21. The latter has an axial passage which receives the rear end portion of the shaft 8 and the front end portion 20 of the shank 10. The baffle 30 has a coaxial hub 15 which surrounds the selected socket 27 and is preferably provided with a radially movable portion which enters the adjacent socket to hold the baffle in a selected axial position. A similar male coupling element can be provided on the bearing or hub 13 of the meat tearing or ripping member 22. The sleeve 21 can be held in a selected axial position by friction. In addition, this sleeve has an internal shoulder (shown in FIG. 2) which abuts the rear end face of the shaft 8. The sleeve 21 also surrounds the front end portion 20 of the shank 10. The conical peripheral surface of the sleeve 21 directs pieces of meat from the discharging end 6 of the barrel 5 toward the passages which are defined by the prongs of the star-shaped member 22 whereby the edges bounding such prongs rip or tear the pieces of meat on their way into the internal space 23 of the extension 2.

By selecting the axial position of the baffle 30 on the shaft 8, the user of the improved meat grinder determines that length of the lateral opening 7 which is used for evacuation of meat between such baffle and the tubular section 18 of the member 1. By selecting the angular position of the element 24 relative to the extension 2, the user of the meat grinder can determine the effective width of the opening 7, namely that portion of the opening 7 which remains exposed by the element 24 (as seen in the circumferential direction of the tubular member 1). FIG. 2 shows the baffle 30 substantially midway between the end wall 3 and the tubular section 18, and the opening 70 of the element 24 is in full or nearly full register with the opening 7 so that approximately one-half of the opening 7 is available for evacuation of meat. The tearing member 22 is adjacent the front end of the sleeve 21 substantially midway between the axial ends of the tubular section 18, and the tips of its prongs can actually abut the internal surface of the member 1 to ensure that the shaft 8 is properly centered.

At least those edges of prongs of the member 22 which confront the barrel 5 are preferably rounded or otherwise dulled to prevent the member 22 from cutting the pieces of meat which are forced (by the feed screw 9) to advance toward and through the passages between the prongs.

The sleeve 21 constitutes an optional but desirable feature of the improved meat grinder. This sleeve directs pieces of meat toward the passages between the prongs of the member 22 and the sleeve also serves to compact the material which advances from the barrel 5 toward the prongs.

The attachment 14 can be readily separated from the barrel 5 by the simple expedient of detaching the nut 11 from the barrel, and all components of the attachment 14 are then ready to be separated from each other for convenient cleaning.

The components 2, 24 and 8 can be separated from each other in response to detachment or loosening of the screw 25. The aforediscussed coupling or holding means permit rapid separation of the member 22 and baffle 30 from the shaft 8 as well as rapid reattachment preparatory to reconnection of the attachment 14 to the barrel 5. The illustrated coupling or holding means for the member 22 and baffle 30 can be replaced with other suitable coupling means without departing from the spirit of the invention. The same holds true for the connection between the shaft 8 and the sleeve 21.

By properly selecting the axial position of the baffle 30 on the shaft 8 and/or by properly selecting the angular position of the tubular element 24 with reference to the extension or outlet element 2, the operator of the meat grinder can select the extent of compression of meat which is evacuated by way of unobstructed portion of the lateral opening 7. The means for holding the baffle 30 in a selected axial position on the shaft 8 can be designed in such a way that the baffle can be moved to any one of a practically infinite number of different axial positions. Analogously, the adjustability of the element 24 relative to the extension is or can be such that the effective area of the opening 7 can be infinitely varied between a maximum value (the opening 7 fully exposed) and a minimum value in which the element 24 fully or nearly fully overlaps the opening 7. Additional ripping or tearing of meat will take place, or is likely to take place, along the circumference of the opening 7, especially if the element 24 is moved to an angular position in which the effective area of the opening 7 is below the maximum value.

If the improved meat grinder is set up to effect at least some compacting of meat in the interior of the tubular member 1 downstream of the tearing or ripping member 22, the feed screw 9 not only serves to advance pieces of meat toward and into the extension 2 but it also performs a desirable tearing or ripping action which increases proportionally or substantially proportionally with the degree of compression or compacting of meat in the extension.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A meat grinder comprising a hollow barrel having a meat admitting end and a meat discharging end; means for conveying melt in said barrel toward said discharging end; a tubular member having a receiving end adjacent said discharging end and an extension having a lateral meat evacuating opening and being remote from said discharging end; a shaft disposed within and spacedly surrounded by said tubular member; and a stationary substantially star-shaped meat tearing member nonrotatably mounted on said shaft between said receiving end of said tubular member and said meat evacuating opening.

2. The meat grinder of claim 1, wherein said extension has an end wall, said opening being disposed between said end wall and said receiving end and further comprising means for fastening said shaft to said end wall.

3. The meat grinder of claim 1, wherein said tubular member comprises a tubular section which is provided with said receiving end and is rigid with said extension, said tearing member being disposed in said tubular section.

4. The meat grinder of claim 1, wherein said tearing member includes a bearing which centers said shaft in said tubular member.

5. The meat grinder of claim 1, wherein said shaft has an end portion at said barrel and said conveying means comprises a feed screw having a rotary shank substantially coaxial with said shaft, and further comprising a sleeve surrounding said end portion of said shaft and a portion of said shank.

6. The meat grinder of claim 5, wherein said sleeve contains a plastic material.

7. The meat grinder of claim 5, further comprising means for releasably coupling said tearing member and said sleeve to said shaft.

8. The meat grinder of claim 1, further comprising means for varying the effective area of said opening.

9. A meat grinder comprising a hollow barrel having a meat admitting end and a meat discharging end; means for conveying meat in said barrel toward said discharging end; a tubular member connected with said barrel and having a receiving end adjacent said discharging end and an outlet element having a lateral meat evacuating opening spaced apart from said receiving end; means for varying the effective area of said opening, said means for varying the effective area of said opening comprising a tubular element having a lateral opening, one of said elements being telescoped into the other of said elements and at least one of said elements being rotatable relative to the other of said elements so as to move the opening of the rotatable element to a position of greater or lesser overlap with the other opening; a shaft disposed within and spacedly surrounded by said tubular member; and a substantially disc-shaped baffle provided on said shaft in said outlet element adjacent the opening of said outlet element.

10. The meat grinder of claim 9, wherein said outlet element is telescoped into said tubular element and said tubular element is rotatable relative to said outlet element.

11. The meat grinder of claim 9, further comprising means for fastening said elements to said shaft.

12. The meat grinder of claim 9, wherein said shaft has an end portion at said barrel and said conveying means comprises a feed screw having a rotary shank which is substantially coaxial with said shaft, and further comprising a sleeve surrounding said end portion of said shaft and a portion of said shank.

13. The meat grinder of claim 9, further comprising means for releasably holding said baffle on said shaft in a selected position axially of said shaft, said holding means comprising a plurality of sockets provided in and spaced apart from one another axially of said shaft.

14. A meat grinder comprising a hollow barrel having a meat admitting end and a meat discharging end; means for conveying meat in said barrel toward said discharging end; a tubular member having a receiving end adjacent said discharging end and an extension having a lateral meat evacuating opening and being remote from said discharging end; a shaft disposed within and spacedly surrounded by said tubular member; a meat tearing member provided on said shaft between the receiving end of said tubular member and said meat evacuating opening; and a baffle provided on said shaft in said extension adjacent said meat evacuating opening.

15. A meat grinder comprising a hollow barrel having a meat admitting end and a meat discharging end; means for conveying meat in said barrel toward said discharging end; a tubular member having a receiving end adjacent said discharging end and an extension having a lateral meat evacuating opening and being remote from said discharging end; a shaft disposed within and spacedly surrounded by said tubular member, said shaft having an end portion at said barrel and said conveying means comprising a feed screw having a rotary shank substantially coaxial with said shaft; a meat tearing member provided on said shaft between the receiving end of said tubular member and said meat evacuating opening; a sleeve surrounding said end portion of said shaft and a portion of said shank; means for releasably coupling said tearing member and said sleeve to said shaft; a baffle provided on said shaft in said extension; and means for releasably coupling said baffle to said shaft.

16. A meat grinder comprising a hollow barrel having a meat admitting end and a meat discharging end; means for conveying meat in said barrel toward said discharging end; a tubular member having a receiving end adjacent said discharging end and an extension having a lateral meat evacuating opening and being remote from said discharging end; a shaft disposed within and spacedly surrounded by said tubular member; a meat tearing member provided on said shaft between the receiving end of said tubular member and said meat evacuating opening; a baffle provided on said shaft in said extension adjacent said meat evacuating opening; and means for releasably holding said baffle on said shaft in a selected position axially of the shaft, said holding means comprising a plurality of sockets provided in and spaced apart from one another axially of said shaft.

* * * * *